US008535072B2

(12) United States Patent
Ma et al.

(10) Patent No.: US 8,535,072 B2
(45) Date of Patent: Sep. 17, 2013

(54) CONNECTOR

(75) Inventors: Zhen-Xing Ma, Shenzhen (CN); Zheng-Heng Sun, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 47 days.

(21) Appl. No.: 13/334,070

(22) Filed: Dec. 22, 2011

(65) Prior Publication Data

US 2013/0157486 A1 Jun. 20, 2013

(30) Foreign Application Priority Data

Dec. 16, 2011 (CN) ..... 2011 1 0423124

(51) Int. Cl.
*H01R 13/44* (2006.01)

(52) U.S. Cl.
USPC ..... 439/148; 439/660; 439/135

(58) Field of Classification Search
USPC ..... 439/148, 135, 138, 660
See application file for complete search history.

(56) References Cited

U.S. PATENT DOCUMENTS

| | | | | |
|---|---|---|---|---|
| 4,662,697 | A * | 5/1987 | Moses | 439/148 |
| 5,601,444 | A * | 2/1997 | Cox | 439/299 |
| 6,676,274 | B1 * | 1/2004 | Rafferty | 362/642 |
| 8,057,244 | B2 * | 11/2011 | Bernstein et al. | 439/135 |
| 8,085,544 | B2 * | 12/2011 | Zhao | 361/737 |
| 2010/0120276 | A1 * | 5/2010 | White | 439/148 |

* cited by examiner

*Primary Examiner* — Hlen Vu
(74) *Attorney, Agent, or Firm* — Altis & Wispro Law Group, Inc.

(57) ABSTRACT

A connector includes a main body, an electrical interface extending from a front end of the main body, and a fixing member pivotably mounted to the main body with a first end. A second end of the fixing member forms a dummy interface similar to the electrical interface.

10 Claims, 3 Drawing Sheets

CONNECTOR

BACKGROUND

1. Technical Field

The present disclosure relates to a connector.

2. Description of Related Art

Peripheral computer devices with connectors, such as universal serial bus (USB) disks or USB transmission lines, are easily lost after being disengaged from the USB interfaces of the computers. However, if the peripheral devices are still connected to the USB interfaces after being used, it can waste power.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
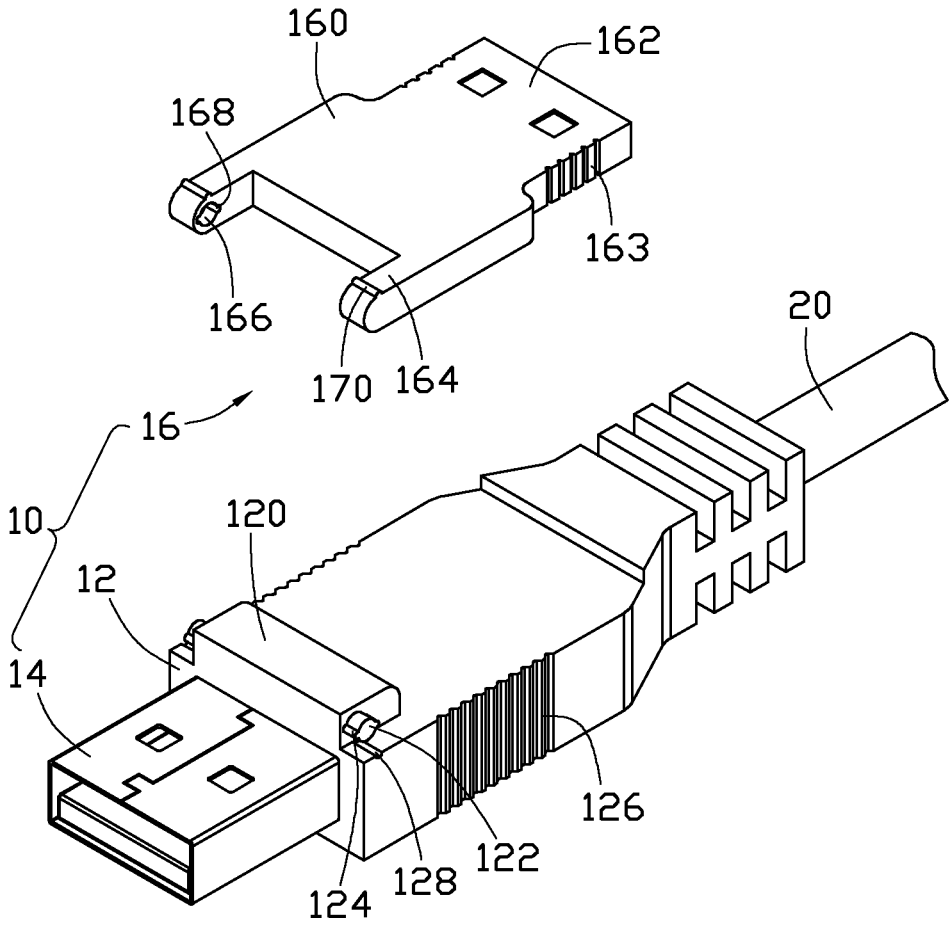
FIG. 1 is an exploded, isometric view of an exemplary embodiment of a connector.

Referring to FIG. 1, an exemplary embodiment of a connector 10 includes a main body 12, an electrical interface 14 extending out from a front end of the main body 12, and a fixing member 16 rotatably mounted to the main body 12 above the interface 14. A cable 20 electrically connected to the interface 14 extends from a rear end of the main body 12 opposite to the interface 14. In the embodiment, the interface 14 is a universal serial bus interface.

A block 120 is formed on the top surface of the main body 12 adjacent to the interface 14. Two columnar rods 122 extend out from opposite ends of the block 120. A deformable protrusion 124 having a semicircular cross-section protrudes from each of a front side and a rear side of a circumference of each rod 122. A positioning slot 128 having a C-shaped cross-section is defined in the top surface of the main body 12 below each of the rods 122. An antiskid portion 126 is formed on each of opposite side surfaces of the main body 12, for conveniently operating the connector 10.

The fixing member 16 includes a connection portion 160, a dummy interface 162 extending out from a rear side of the connection portion 160 and having a configuration similar to the interface 14, and two legs 164 extending out from opposite ends of a front side of the connection portion 160 opposite to the dummy interface 162. A handing portion 163 is formed on each of opposite end surfaces of the dummy interface 162. The thickness of the dummy interface 162 is less than the interface 14. The front side surface of each leg 164 opposite to the simulate interface 162 is arc-shaped. A round pivot hole 166 is defined in an inner surface of each leg 164 facing the other leg 164. Two positioning slots 168 similar to the positioning slots 128 are defined in the inner surface of each leg 164, communicating with the corresponding pivot hole 166. A deformable protrusion 170 similar to the protrusions 124 protrudes from each of a top and a bottom of each leg 164.

Figure 2:
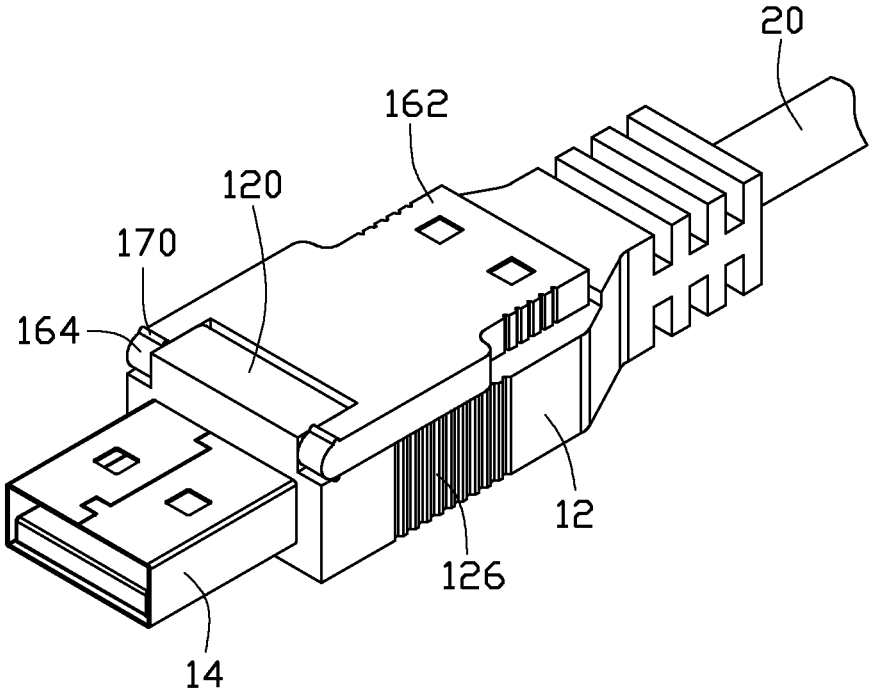
FIG. 2 is an assembled, isometric view of the connector of FIG. 1.
Figure 3:
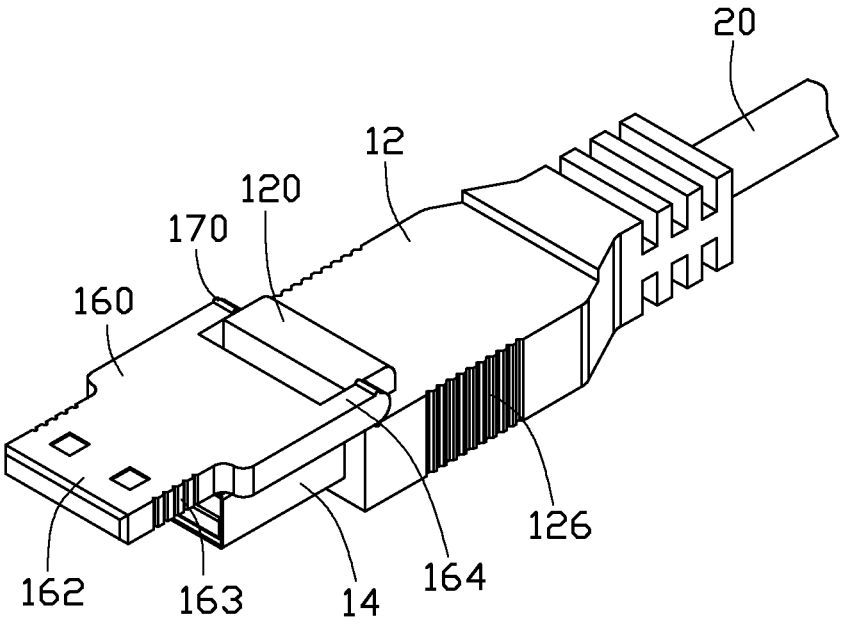
FIG. 3 is similar to FIG. 2, but shows a using state.

Referring to FIGS. 2 and 3, in assembly, the legs 164 are deformed away from each other. The rods 122 are rotatably engaged in the corresponding pivot holes 166, and the protrusions 124 are abutted against the corresponding inner surfaces bounding the pivot holes. 166. The fixing member 16 is pivoted backward about the rods 122, until the fixing member 16 contacts the top surface of the main body 12. The protrusions 170 positioning at the bottoms of the legs 164 are engaged in the corresponding positioning slots 128. The protrusions 124 are restored and engaged in the corresponding positioning slots 168.

When the connector 10 is used to communicate with a computer (not shown), the interface 14 is inserted into an interface of the computer.

When the connector 10 is not needed, the interface 14 is disengaged from the interface of the computer. The fixing member 16 is pivoted forward for 180 degrees about the rods 122, until the protrusions 170 positioning at the tops of the legs 164 are engaged in the corresponding positioning slots 128. Each protrusion 124 is engaged in the other one of the positioning slots 168. The dummy interface 162 are extended out of the interface 14 to be inserted into the interface of the computer, and the handing portions 163 are abutted against opposite sidewalls bounding the interface of the computer, to fix the dummy interface 162 in the interface of the computer.

In other embodiments, the positioning slots 168 and the protrusions 124 may be omitted.

It is believed that the present embodiments and their advantages will be understood from the foregoing description, and various changes may be made thereto without departing from the spirit and scope of the description or sacrificing all of their material advantages, the examples hereinbefore described merely being exemplary embodiments.

What is claimed is:

1. A connector, comprising:

a main body;

an electrical interface extending from an end of the main body; and a fixing member comprising a first end pivotably mounted to the main body, and a second end forming a dummy interface, wherein the fixing member is pivoted to allow the dummy interface to extend out of the electrical interface to replace the electrical interface when the electrical interface is not in use;

wherein the fixing member comprises a connection portion, and the first end comprises two legs extending out from a first side of the connection portion, a pivot hole is defined in an inner surface of each leg facing the other leg, a block is formed on the end of the main body, two rods extend from opposite ends of the block and are rotatably received in the corresponding pivot holes, the second end extends from a second side of the connection portion opposite to the first side.

2. The connector of claim 1, wherein a positioning slot is defined in the main body below each rod, a protrusion protrudes from each of a top and a bottom of each leg to be selectively engaged in a corresponding one of the positioning slots.

3. The connector of claim 1, wherein an end surface of each leg opposite to the dummy interface is arc-shaped.

4. The connector of claim 1, wherein two positioning slots are defined in the inner surface of each leg, communicating with the corresponding pivot hole, two protrusions protrude from each of the rods to be respectively engaged in the corresponding positioning slots.

5. The connector of claim 1, wherein a handing portion is formed on each of opposite end surfaces of the connection portion.

6. The connector of claim 1, wherein an antiskid portion is formed on each of opposite side surfaces of the main body.

7. The connector of claim 1, wherein the electrical interface is a universal serial bus interface.

8. A connector comprising:

a main body;

an electrical interface extending from an end of the main body to be inserted in an interface of an electronic device when the electrical interface is in use; and a fixing member comprising a first end movably mounted to the main body, and a second end forming a dummy interface, wherein the dummy interface is capable of extending out of the electrical interface, and configured to replace the electrical interface to be inserted in the interface of the electronic device when the electrical interface is not in use, and the fixing member is pivoted to another position relative to the electrical interface.

9. The connector of claim 8, wherein the first end comprises two legs, a pivot hole is defined in an inner surface of each leg facing the other leg, a block is formed on the end of the main body, and two rods extend from opposite ends of the block and are rotatably received in the corresponding pivot holes.

10. The connector of claim 9, wherein a positioning slot is defined in the main body below each rod, and a protrusion protrudes from each of a top and a bottom of each leg to be selectively engaged in a corresponding one of the positioning slots.

* * * * *